US007239280B2

(12) United States Patent
Kordass et al.

(10) Patent No.: US 7,239,280 B2
(45) Date of Patent: Jul. 3, 2007

(54) ANTENNA COMPRISING A PLASTIC HOUSING

(75) Inventors: Joachim Kordass, Koengen (DE); Günther Blickle, Kusterdingen (DE); Boris Wischniowski, Stuttgart (DE)

(73) Assignee: Hirschmann Electronics GmbH & Co. KG, Neckartenzlingen (DE)

( * ) Notice: Subject to any disclaimer, the term of this patent is extended or adjusted under 35 U.S.C. 154(b) by 0 days.

(21) Appl. No.: 10/549,833

(22) PCT Filed: Jan. 22, 2004

(86) PCT No.: PCT/EP2004/000486

§ 371 (c)(1),
(2), (4) Date: Jun. 20, 2006

(87) PCT Pub. No.: WO2004/084342

PCT Pub. Date: Sep. 30, 2004

(65) Prior Publication Data

US 2007/0035459 A1 Feb. 15, 2007

(30) Foreign Application Priority Data

Mar. 18, 2003 (DE) ..... 103 11 835

(51) Int. Cl.
*H01Q 1/32* (2006.01)

(52) U.S. Cl. ..... 343/711; 343/713; 343/872

(58) Field of Classification Search ..... 343/711, 343/713, 872, 878
See application file for complete search history.

(56) References Cited

U.S. PATENT DOCUMENTS

| | | | | |
|---|---|---|---|---|
| 5,568,157 | A | 10/1996 | Anderson | 343/713 |
| 6,879,301 | B2 * | 4/2005 | Kozlovski | 343/878 |
| 6,999,033 | B2 * | 2/2006 | Kordass et al. | 343/713 |
| 7,002,523 | B2 * | 2/2006 | Noro | 343/713 |
| 7,046,207 | B2 * | 5/2006 | Takahashi | 343/711 |
| 7,106,272 | B2 * | 9/2006 | Noro et al. | 343/872 |
| 2004/0150572 | A1 * | 8/2004 | Ohno et al. | 343/711 |
| 2006/0214860 | A1 * | 9/2006 | Hayashi et al. | 343/713 |

FOREIGN PATENT DOCUMENTS

| | | |
|---|---|---|
| DE | 295 00 961.6 | 7/1995 |
| DE | 295 06 693 | 8/1995 |
| DE | 202 04 863 | 10/2002 |
| JP | 10-215116 | 10/1998 |
| JP | 2000-68722 | 3/2000 |
| WO | WO 02/065579 | 8/2002 |

* cited by examiner

*Primary Examiner*—Tan Ho
(74) *Attorney, Agent, or Firm*—Alfred Wilford

(57) ABSTRACT

The invention relates to a vehicle antenna (1), designed to be mounted on a vehicle surface (4). Said antenna comprises a base body (2) consisting of metal and a plastic antenna housing (3), which surrounds the antenna elements that are placed on the base body (2). According to the invention, the base body (2) has at least one sub-section (2.2) consisting of plastic and the antenna housing (3) is permanently connected to said sub-section (2.2) once the antenna elements have been mounted.

7 Claims, 1 Drawing Sheet

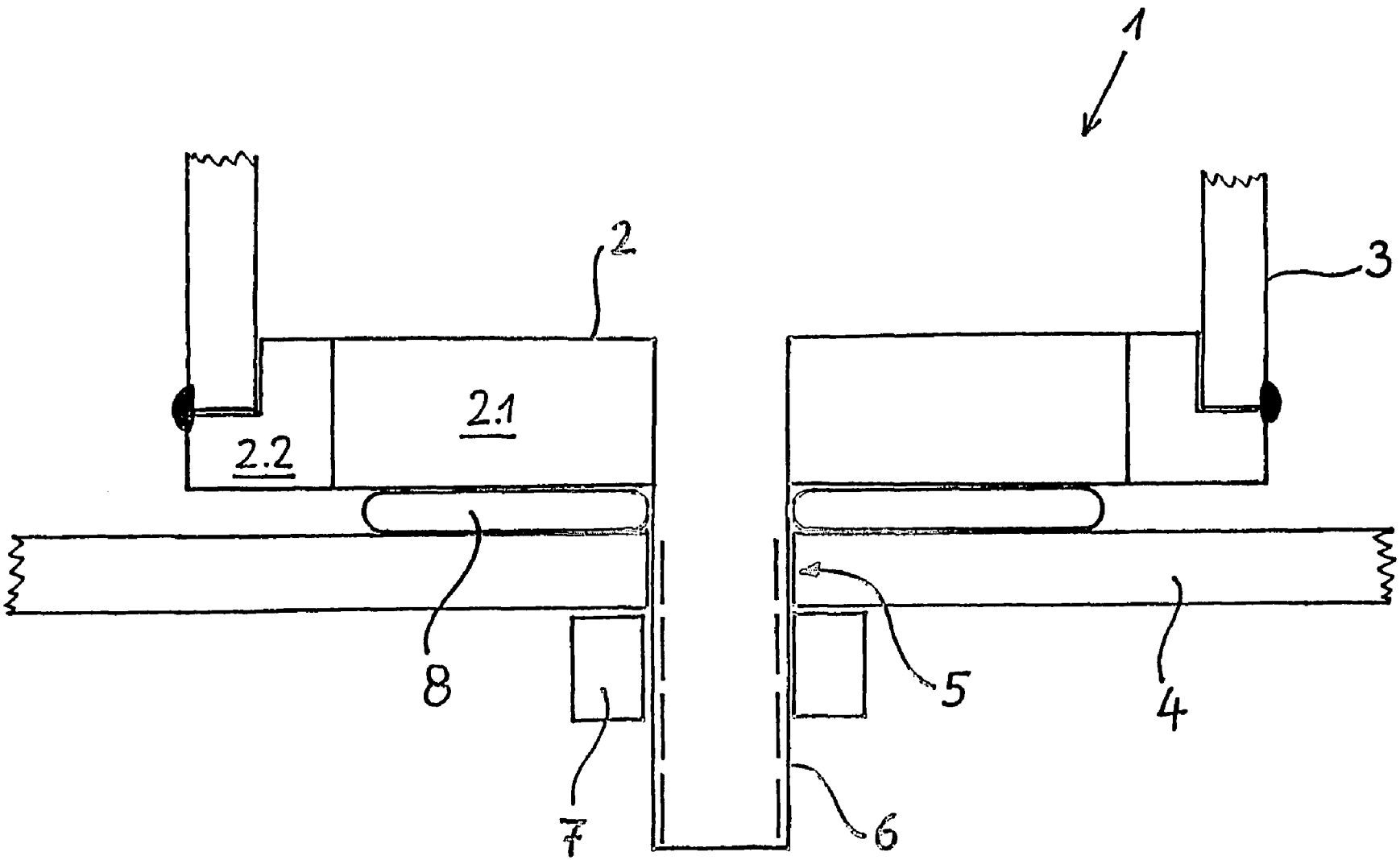
1
2
2.1
2.2
3
4
5
6
7
8

ANTENNA COMPRISING A PLASTIC HOUSING

CROSS REFERENCE TO RELATED APPLICATIONS

This application is the US national phase of PCT application PCT/EP2004/000486, filed 22 Jan. 2004, published 30 Sep. 2004 as WO 2004/084342, and claiming the priority of German patent application 10311835.7 itself filed 18 Mar. 2003.

1. Field of the Invention

The invention relates to a vehicle antenna mountable on a vehicle surface, in particular a vehicle roof, according to the features of the introductory clause of claim 1.

2. State of the Art

Such a vehicle antenna is known from DE 295 00 961. This antenna has a base plate (base body) of metal on which the necessary elements (as for example a conductive-strip antenna) is mounted. To protect the antenna elements mounted on the base plate, they are covered by an antenna housing that is made of a nonconductive material like plastic. A threaded bolt extends from the base plate through a hole in the vehicle roof to secure the entire antenna to the vehicle roof.

The base plate of the antenna of DE 259 00 961 fits in a downwardly open cavity of the antenna housing. In order to secure the antenna housing on the base plate there are holes in the four corners of the base plate. Screws project through these holes and are seated in complementary threaded bores in the antenna housing. In this manner the antenna housing and the base plate can be separated from each other but there is no real seal action. This means that foreign particles and above all moisture can get into the antenna housing and impair operation of the antenna. Another disadvantage is the assembly and the number of parts, since it is first necessary to provide the holes on the base plate and then the antenna housing has to be provided with threaded inserts. Then the screws must be installed to form the connection between the base plate and the antenna housing. Subsequently, steps must be taken to tighten the screws in the antenna housing so that in use they do not loosen from the vehicle's vibration and the antenna housing goes lost.

OBJECT OF THE INVENTION

It is an object of the invention to provide a vehicle antenna for mounting on a vehicle surface, in particular a vehicle roof, that avoids these described disadvantages. This object is attained by the features of claim 1.

According to the invention the base body has at least one plastic part, the antenna housing being permanently joined to the part after the antenna elements are installed. This has on the one hand the advantage that assembly is simplified and the number of parts is reduced. The permanent joint that can for example be a glue joint or an ultrasound weld can made during automated attachment of the antenna elements. Since in the region where the antenna housing is joined to the base plate, they are both of the same material or of materials that can be easily bonded together, this connection is fast and simple, and also inexpensive. Once the permanent joint is made, the interior of the antenna housing is hermetically sealed, so that deterioration of the operation of the antenna is effectively avoided since now no foreign particles or moisture can get into the interior.

Furthermore according to the invention the antenna housing is snugly fitted with the part where it is joined thereto.

Thus the antenna housing is positioned and fixed on or in the base plate so that subsequently the permanent joint can be made without difficulty.

According to further features of the invention the plastic part extends peripherally around the metal part of the base body. When the plastic part extends peripherally around the edge of the base plate, which is particularly easy to do by spraying it on, there is a fairly large surface available for installing the antenna elements. In addition the assembly has an attractive appearance, since the antenna housing smoothly fits over the edge of the base plate.

BRIEF DESCRIPTION OF THE DRAWING

An embodiment, to which the invention is not restricted, is described in the following and described with reference to the FIGURE.

EMBODIMENT OF THE INVENTION

A schematically illustrated antenna 1 has a base body 2, the base body 2 having a metallic part 2.1 that is absolutely necessary for the functioning of the antenna 1. According to the invention the base body 2 also has at least one plastic part 2.2 that in the embodiment extends peripherally around the outer edge of the metal part 2.1. It is also possible that the plastic part 2.2 also extends for example partly as a thin layer over the metal part 2.1. A plastic housing 3 that contains and protects the antenna elements (if necessary including electronic parts as for example an amplifier) that are mounted on the base body 2 is set over the base body 2. The antenna elements can be different according to the use to which the antenna 1 is put and are for simplicity of view not shown in the drawing. To seal the interior of the housing 3 it is here provided that the engaging surfaces of the housing 3 and the part 2.2 of the base plate 2 are joined permanently together. To this end the engaging edges of the housing 3 and part 2 are fitted together, for example at a shoulder in the part 2.2 shown in the figure. It is also for example possible that the part 2.2 have a peripheral annular groove in which a lower edge of the housing 3 engages. Such a formation is particularly usable when the housing 3 is to be glued to the part 2.2. The permanent connection between the housing 3 and the part 2 is shown at V in the drawing.

In this embodiment the antenna 1 is shown mounted on a vehicle surface 4. This vehicle surface 4 has a hole 5 (body hole) in which a (threaded) projection 6 engages, the projection 6 being part of the base body 2. In order to secure the antenna 1 on the vehicle surface 4, a hex nut 7 is for example threaded over the projection 6. To seal the antenna 1 (and the base plate 2) relative to the vehicle surface 4 with respect to the underneath passenger compartment, there is also a seal 8 that is so constructed that the hole 5 is effectively sealed to prevent foreign particles or moisture from getting in from outside.

The invention claimed is:

1. A vehicle antenna mountable on a vehicle surface, the antenna comprising:

a flat metallic plate having an outer edge;

a plastic part fixed integrally on the metallic plate, extending around the plate outer edge, and forming a mounting surface;

means fixing the metallic plate on the vehicle surface;

a plurality of antenna elements mounted on the metallic plate;

a hollow plastic housing fittable over the antenna element, engaging the mounting surface of the plastic part, and containing the elements with the metallic plate; and means forming a permanent joint at between the plastic housing and the plastic part.

2. The vehicle antenna defined in claim 1 wherein the housing and mounting surface fit complementarily together.

3. The vehicle antenna defined in claim 1 wherein the plastic part is a plastic coating sprayed on the metallic plate.

4. The vehicle antenna defined in claim 1 wherein the joint is a glue joint.

5. The vehicle antenna defined in claim 1 wherein the joint is an ultrasonic weld.

6. The vehicle antenna defined in claim 1, further comprising a seal between the metallic plate and the vehicle surface.

7. The vehicle antenna defined in claim 1 wherein the mounting surface is an annular seat, the housing having an edge complementarily fittable in the seat.

* * * * *